350-336 SR R
XR 3,959,963
1 X 3108 H

United States 3,959,963
Murrell June 1, 1976

[54] SOLID-STATE DISPLAY FOR TIME-PIECE

[76] Inventor: Nicholas John Murrell, 23, The Wynd, Dalgety Bay, Fife, Scotland

[22] Filed: Oct. 29, 1974

[21] Appl. No.: 518,835

[30] Foreign Application Priority Data

Oct. 29, 1973 United Kingdom ..... 50182/73

[52] U.S. Cl. ..... 58/50 R; 58/127 R; 313/500; 340/378 R; 350/160 LC

[51] Int. Cl.[2] ..... G04B 19/30; G04B 19/06; H01J 63/04

[58] Field of Search ..... 58/23 R, 50 R, 127 R; 313/500; 340/378 R; 350/160 LC

[56] References Cited

UNITED STATES PATENTS

| | | | |
|---|---|---|---|
| 3,258,906 | 7/1966 | Demby | 58/50 R |
| 3,276,200 | 10/1966 | Freeman | 58/50 R |
| 3,540,209 | 11/1970 | Latsky et al. | 58/50 R |
| 3,691,755 | 9/1972 | Girard | 58/50 R |
| 3,765,163 | 10/1973 | Levine | 58/50 R |

*Primary Examiner*—Edith Simmons Jackmon
*Attorney, Agent, or Firm*—Henry M. Bissell

[57] ABSTRACT

The face of a watch or clock is made up of electro-optical devices, such as liquid crystal devices, arranged to present radial bars each divided into an inner segment and an outer segment and the segments can be illuminated by an electronic drive circuit having a time-base generator such as a quartz-crystal oscillator. The drive circuit has a time multiplex system for scanning the bars and selects segments for illumination such that a minute hand is simulated by illumination of both segments of a bar, an hour hand is simulated by illumination of an inner segment alone, and a seconds display is provided by illumination of the outer segments in turn.

7 Claims, 3 Drawing Figures

Figure 1:
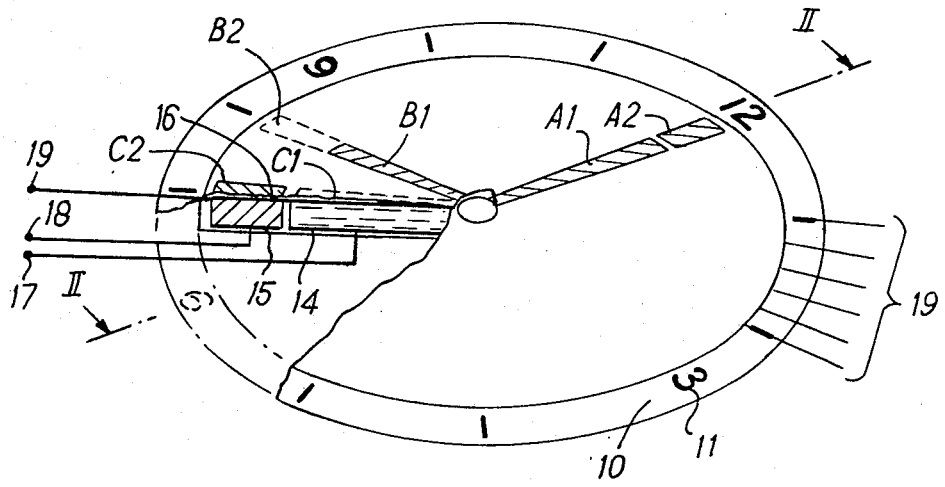

3959963
OR IN 58/50R

SOLID-STATE DISPLAY FOR TIME-PIECE

The present invention relates to a solid state display system for a time-piece, such as a watch or clock.

In conventional watches and clocks the time is displayed by rotation of hour and minute hands over a dial. With the introduction of watches in which a tuning fork or quartz crystal is used as a frequency standard to give increased accuracy the same form of display can be retained but the drive system for driving the hands from a micro-motor or solenoid by means of a gear train has to be made with precision in small sizes and is therefore expensive.

The use of a solid state display system offers the possibility of producing a time-piece of high accuracy at much lower cost. At present solid state displays use a seven segment format to display numerals representing the actual time at the instant of observation. Much more commonly, however, the user wants to know how much time has elapsed since the start of a particular period or how long it will be before a particular time is reached. The conventional watch face is very much more convenient for these purposes since it is not necessary to do any mental arithmetic in order to see, for example, that there are about 20 minutes to go before your appointment at 11.45. Accordingly various solid state displays have been experimentally produced which use ring and dots to display the time diagrammatically instead of in numerical form. However none of the proposed display systems is as easy to read as the conventional clock or watch face with moving hour and minute hands, largely because none of them has a visible central focal point about which the indicator dots move.

In accordance with the present invention there is provided a time-piece with a display face formed by electro-optical devices presenting a plurality of bars radiating from a central point, at least some of the bars, occurring at equal intervals around the central point, having an inner segment, the time-piece having an electronic drive circuit whereby each bar in turn can be rendered visible by contrast with the other bars to simulate a minute hand, and each of the inner segments in turn can be rendered visible by contrast with the other inner segments to simulate an hour hand.

Preferably all the bars consist of an inner segment and an outer segment and the outer segments are rendered visible in turn to indicate seconds. Preferably there are 60 bars each divided into inner and outer segments so that the outer segments indicate 60 seconds for a complete cycle, after which the "minute hand", simulated by a complete bar, moves on one place. Every 12 minutes the "hour hand" represented by an inner segment moves on one place.

The electro-optical devices used in the display may be individual solid-state devices such as light-emitting diodes which become visible when electrically energized. They may also, where space allows, be electric filament or discharge lamps. Other devices which can be used depend upon materials whose optical properties are changed by applied electric fields, currents, or voltages, or magnetic fields, for example liquid crystal devices and devices relying upon the phenomenon of electrophoresis. In such cases it is sometimes possible for the devices all to use a common body of material and even to have some electrodes in common. For example in an embodiment to be described in more detail below a liquid crystal display uses a single liquid-filled cell with a pair of ring electrodes on one side and a number of radially extending electrodes on the opposite side so that individually-operable devices are formed between each of the radial electrodes and the pair of ring electrodes.

When the electro-optical devices depend upon a change in optical properties rather than emission of light, a particular device may be visible relative to the others either because it is the only one to which an electrical signal has been applied or because it is the only one to which an electrical signal has not been applied. It may be visible because it is reflecting, or transmitting, more light or less light than the other devices.

Conveniently the electronic drive circuit is a time multiplex circuit which causes "bright-up" of the appropriate bar segments at intervals sufficiently small for the selected bar segments to be perceived as continuously visible by the user. In a preferred form electrical connections are made to two concentric rings, one common to all the inner segments and the other common to all the outer segments, and signals are applied to select whether an inner segment or an outer segment or both are to be made visible and connections are also made from the multiplex system to individual terminals for each of the bars to select which bars are to have one or both segments made visible.

Figure 2:
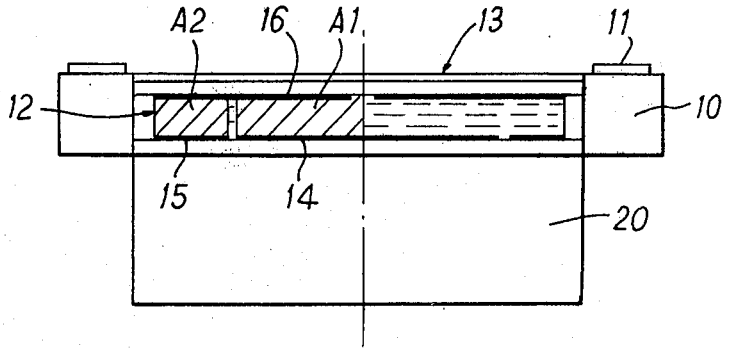
Figure 3:
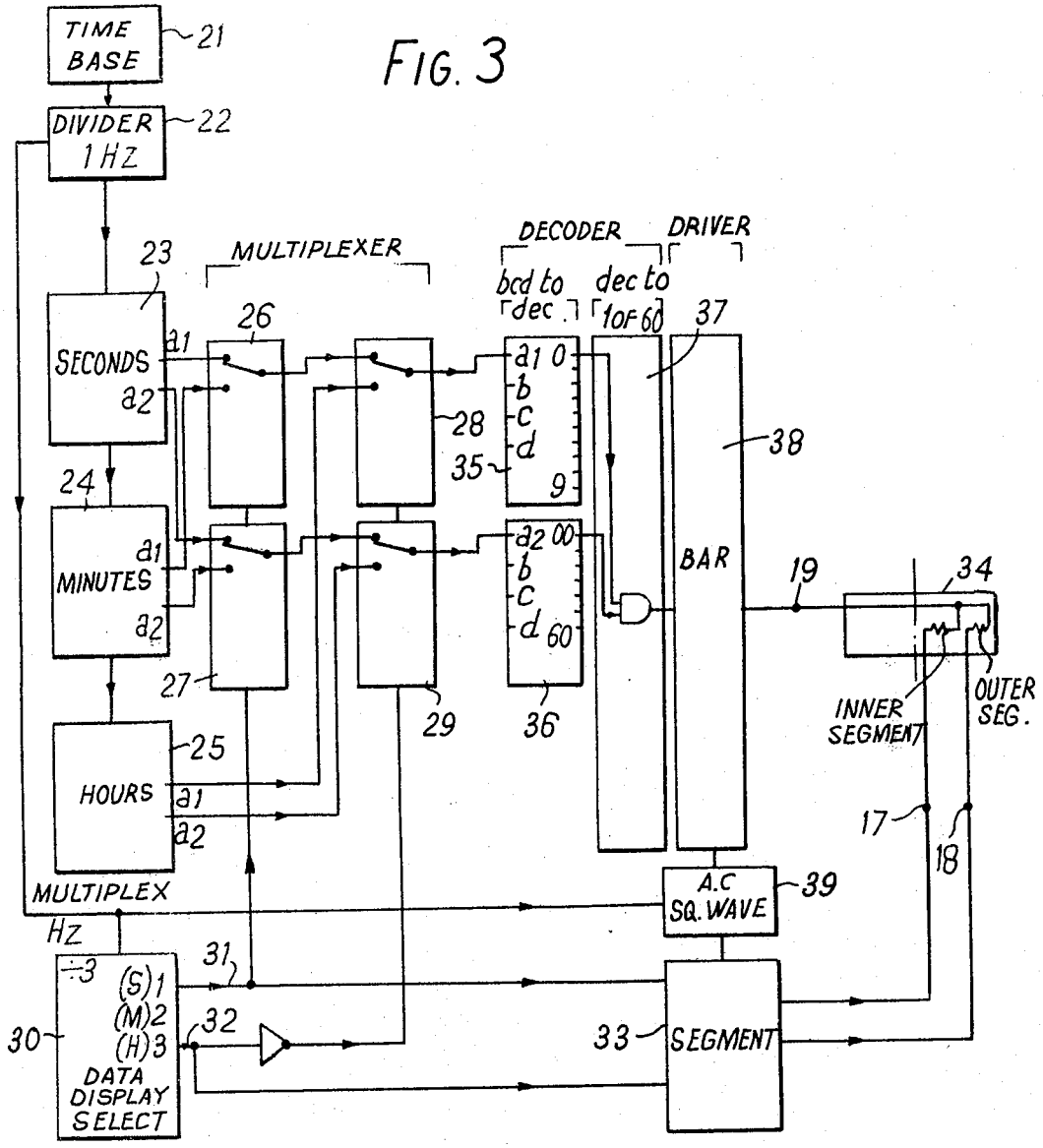

The invention will be described in more detail with the aid of examples illustrated in the accompanying drawings, in which :

FIG. 1 shows the face of a time-piece in accordance with the invention and indicates diagrammatically the elements for creating the display, FIG. 2 is a diagrammatic section of the time-piece of FIG. 1 on the line II—II in FIG. 1, the thickness of the various layers being much enlarged relative to their area in order to show the structure more clearly, and FIG. 3 is a block circuit diagram of the time-piece of FIG. 1 showing the manner in which the elements of the display are controlled.

As shown in FIG. 1, the time-piece has an outer ring 10 with graduations 11 showing 5-minute intervals and, if desired, further subdivisions of one hour in a conventional form. The ring 10 is raised above a display layer 12. A cover disc 13 with an anti-reflection surface is placed within and flush with the ring 10. Below the ring 10 and the cover disc 13 is the display layer 12 incorporating electro-optical display elements. These display elements are arranged to form 60 radially-extending bars each of which is composed of two elements or segments. For clarity of illustration only three bars are shown, which are formed by segments A1 and A2, B1 and B2, and C1 and C2. It will be convenient to refer to the bar composed of segments A1 and A2 as bar A and similarly for the other bars. Underlying the display elements on the inner face of the display layer there are two concentric electrodes, a disc 14 and a surrounding ring 15. Each of these electrodes is composed of a deposited film which is substantially transparent. The disc electrode 14 is common to the radially-inner segments A1, B1, C1 . . . while the ring electrode 15 is common to the radially-outer segments A2, B2, C2 . . .

On the outer face of the display layer there are 60 radial bar electrodes 16 each of which is in register with one of the bars A, B, C . . . and is common to the two bar segments A1 and A2, B1 and B2, . . . The electrodes 16 are also formed by a deposited film which is substantially transparent. The electrical connections to the electrodes are schematically illustrated in FIG. 1 by terminals 17 and 18 connected to the electrodes 14 and 15, respectively, and by a series of terminals 19 individually connected to the bar electrodes 16. In addition to the terminal 19 for the electrode 16 of the bar C another six of the terminals 19 have been shown, being those corresponding to a five-minute period of the graduations 11. The display layer is carried by a block 20 containing the electronic circuits of the time-piece and the terminals 17, 18 and 19 are in practice within the block 20, electrical connections being made to the electrodes in any convenient manner.

In FIG. 1 the bar segments which are cross-hatched are those which have been made visible by the applicaton of the appropriate electrical signals. Segments A1 and A2 are both visible and thus create a visible bar A which is the minute hand of the display. The hour hand is formed by the visible inner bar segment B1. Outer segment B2 is indicated in broken lines but is not at this time a visible part of the display. Outer segment C2, on the other hand, is visible and forms a seconds indicator. The display thus shows 35 seconds after 8 o'clock. Each second a new outer segment will be made visible so that five seconds later the outer segment B2 will be visible but not C2 or any of the other outer segments. After a further 20 seconds it will be the turn of A2 to represent the seconds and at the same time the minute hand must move on by one minute which is achieved by making both segments of the next bar visible while making A1 invisible. When the time has advanced to 8.35 both C1 and C2 will be visible to form the minute hand and the hour hand will have advanced two places, i.e. to the second inner bar segment after B1. The hour hand advances one place every 12 minutes in order to bring it to the next hour position after 60 minutes.

FIG. 3 illustrates in the form of a block circuit diagram one way in which the desired sequence of operation of the display elements can be effected. This circuit is designed for the case where the display elements are liquid crystal devices which become opaque upon the applicaton of an electric field because of the alignment of the crystal structure in the field. Such devices require the applicaton of an alternating field.

The circuit is controlled by a time base in the form of a crystal oscillator 21. Pulses from the oscillator 21 pass to a 16-stage divider 22 which delivers one pulse per second to a seconds counter 23. The seconds counter in turn delivers one pulse per minute to a minutes counter 24, which delivers twelve pulses per hour to an hours counter 25. The outputs of the counters 23, 24 and 25 are fed in binary coded decimal form to a multiplexer consisting of switching units 26, 27, 28 and 29 which receive pairs of inputs from the counters as shown. The switching units 26 to 29 are controlled by a data display selection circuit 30 which receives pulses from the divider 22 at the multiplex frequency and by means of a divide-by-3 divider delivers in turn a "seconds" output on line 31, a "minutes" output on lines 31 and 32, and an "hours" output on line 32. These outputs are also delivered by way of a segment drive circuit 33 to terminals 17 and 18 of the display unit, which is represented diagrammatically at 34 in FIG. 3.

The outputs of switching units 28 and 29 of the multiplexer pass to decoding units 35 and 36 which convert the signals from binary coded decimal to decimal and pass them to a further decoding unit 37 which converts decimal to 1 to 60 . From here the signals pass by way of a bar driver circuit 38 to the terminals 19 of the display unit 34 in order to select individual bars of the display. An A.C. square wave generator 39 driven at multiplex frequency by signals from the divider 22 provides the alternating field required by the liquid crystal devices of the display unit.

In response to the pulses from the divider, which may for example occur at a rate of 40 pulses per second, the selection circuit 30 switches the multiplexer between the seconds, minutes and hours counters 23, 24 and 25 and synchronously switches the segment driver 33 between three states in which it feeds the electrode 15, the electrodes 14 and 15, and the electrode 14, respectively. The multiplexer feeds one of the bar electrodes 16 selected in accordance with the value in the counter to which the multiplexer is connected and the required segment or segments are energized from the continuously-operating A.C. generator 39 to indicate seconds, minutes or hours.

By way of example details will now be given of the way in which the circuit of FIG. 3 can be made up from standard cos/mos digital integrated circuits supplied by R.C.A. Corporation as their CD4000 series. Similar circuits are available from other manufacturers, for example the Motorola MC14000 series.

Display Unit (34)

This may be a liquid crystal display unit of R.C.A. Type TA8054, the arrangement of the electrodes being modified to give the required clock face instead of a seven element numerical display.

Time Base (21)

The 1Hz time base may be derived from atomic, radio signal, quartz crystal, mains supply or other source such as a master clock system. Example of cos/mos logic: quartz crystal oscillator - 262.144 Kc R.C.A. buffer - 1 nor gate of CD4002.

Divider (22)

The divider is the appropriate one for use with the particular time base and is used to generate the 1Hz pulse to drive the seconds, minutes and hours counters. A second output is used to drive the data display select/multiplexer, the frequency depending on the type of display being driven.

| | |
|---|---|
| Example of cos/mos logic: divider | 7 stage — CD4024 binary counter<br>14 stage — CD4020 binary counter. |

Counter (23, 24, 25)

The counter consists of divide by 10 and divide by 6 stages with BCD coded outputs, other codes may be used i.e. excess gray, octal etc. The hours 'hand' is advanced once every 12 minutes — 60 segments every 12 hours.

| | |
|---|---|
| Example of cos/mos logic: counter, | seconds — CD4029 or CD4083<br>minutes — CD4029 or CD4083<br>hours — CD4029 or CD4083. |

A number of different standard packages are available in cos/mos which will perform the required functions.

Multiplexer (26–29)

The output from the seconds, minutes and hours counters are routed through the multiplexer which in conjunction with the bar selected show the seconds, minutes and hours on the display in rotation, but at a speed that the seconds, minutes and hours appear to be simultaneously displayed. Example of cos/mos logic: multiplexer - CD4019.

Data Display Select (30)

This controls the multiplexer and inner/outer bar selected so that bar outputs to the display are in the correct phase with the multiplexed decoded outputs. Example of cos/mos logic: Data display select - CD4018.

Decoder (35-37)

The BCD output from the multiplexer is decoded from BCD into decimal and then from decimal into 1 of 60.

| | | |
|---|---|---|
| Example of cos/mos logic: | BCD to decimal | — CD4028 |
| | 1 to 60 | — CD4081 |

Driver

This depends on the type of display being driven. Examples are given for light emitting diodes and liquid-crystal display drivers.

| | |
|---|---|
| Example of cos/mos logic: | LED Driver — CA3082 |
| | LCD Driver — CD4030. |

In place of the liquid crystal display devices it is possible to use electrophoresis devices or magnetic film devices. In the former suspended particles are caused to deposit on one of the electrodes and thus render the device opaque when an electric field is applied. In the latter magnetized particles are oriented by an applied magnetic field to create an opaque condition. For both these types of device the circuit used is essentially the same as that shown in FIG. 3.

A further alternative is the use of light-emitting diodes as the display devices and in this case direct current is required instead of alternating current, which requires omission of item 39 in FIG. 3 and consequent modifications. It is possible to use a separate diode or group of diodes for the hour hand and the minute hand of the display, the diodes of the two hands being poled in opposite directions so that the direction of the current selects either the hour hand or the minute hand.

I claim:

1. A time-piece comprising:

a display having a display layer composed of electro-optical display elements disposed about a central point;

a plurality of bar electrodes on one face of the display layer radiating from the central point of the display and defining segmented radial bars of the display;

inner and outer concentric ring electrode means on the other face of the display layer, the inner ring electrode means being common to all of said bar electrodes and defining therewith inner segments of said radial bars, the outer ring electrode means being common to all of said bar electrodes and defining therewith outer segments of said radial bars; and an electronic drive circuit connected to said electrodes and electrode means, the circuit comprising means for rendering the whole of each of the bars in turn visible by contrast with the other bars to simulate a minute hand, rendering each of the inner segments in turn visible by contrast with the other inner segments to simulate an hour hand, and rendering each of the outer segments in turn visible by contrast with the other segments to simulate a second hand.

2. A time-piece as claimed in claim 1 wherein each of the ring electrode means consists of a single conductive element.

3. A time-piece as claimed in claim 1 in which the drive circuit comprises means for scanning the individual bar electrodes at a rate sufficient to ensure that any segment which is rendered visible once in each scan appears to the user as continuously visible, and means to selectively energize both of the ring electrode means when a complete bar is to be rendered visible and to energize a selected one of the ring electrode means when only a segment is to be rendered visible.

4. A time-piece as claimed in claim 1 in which the drive circuit comprises a time-base generator, seconds, minutes and hours counters coupled to receive pulses derived from the time-base generator, a data display selection circuit also coupled to receive pulses derived from the time-base generator and having two outputs for selective energization of the two ring electrode means, a multiplexer coupled to be controlled by the outputs of the selection circuit and to derive input signals from the counters, first means for selectively coupling the multiplexer to the bar electrodes and second means for selectively coupling the outputs of the selection circuit to the ring electrode means.

5. A time-piece as claimed in claim 4 further including an A.C. square wave generator for coupling between the opposite electrodes of the selected electro-optical display elements by the first and second means.

6. A time-piece as claimed in claim 1 in which the electrooptical display elements are liquid crystal devices mounted in a common envelope and sharing a common body of liquid.

7. A time-piece as claimed in claim 1 in which the electrooptical display elements are light-emitting diodes.

* * * * *